US011564504B2

(12) United States Patent
Hover

(10) Patent No.: US 11,564,504 B2
(45) Date of Patent: Jan. 31, 2023

(54) BEDSIDE RAIL

(71) Applicant: Alan Paul Hover, Gladwin, MI (US)

(72) Inventor: Alan Paul Hover, Gladwin, MI (US)

( * ) Notice: Subject to any disclaimer, the term of this patent is extended or adjusted under 35 U.S.C. 154(b) by 0 days.

(21) Appl. No.: 16/948,721

(22) Filed: Sep. 30, 2020

(65) Prior Publication Data

US 2022/0095804 A1 Mar. 31, 2022

(51) Int. Cl.
*A47C 21/08* (2006.01)
*A47C 19/04* (2006.01)

(52) U.S. Cl.
CPC ..... *A47C 21/08* (2013.01); *A47C 19/04* (2013.01)

(58) Field of Classification Search
CPC ..... A47C 19/04; A47C 21/08; A61G 7/053; A61G 7/0533
See application file for complete search history.

(56) References Cited

U.S. PATENT DOCUMENTS 7,103,928 B1 * 9/2006 Childs ..... A61G 7/0518 5/426
7,987,538 B1 * 8/2011 Kimball ..... A61G 7/0524 5/662
2007/0083994 A1 * 4/2007 Miller ..... A47C 21/08 5/430
2007/0089242 A1 * 4/2007 Battiston ..... A47C 21/08 5/662
2021/0369523 A1 * 12/2021 Kousik ..... A47C 21/00

* cited by examiner

*Primary Examiner* — David R Hare
*Assistant Examiner* — Adam C Ortiz
(74) *Attorney, Agent, or Firm* — Dunlap Bennett & Ludwig, PLLC

(57) ABSTRACT

A bedside rail, a system of coordinating two bedside rails, and a method of using the one or more bedside rails to prevent a user of an associated mattress from having their elbows slide off the mattress. Each bedside rail has an adjustable vertical component as well as an adjustable bar that can separately moves along the vertical component. A supporting line can extend between the adjustable bars of two bedside rails along opposing sides of a mattress. A cushioned portion over the vertical component can be selectively elevated adjacent to and above a top surface of the mattress along both sides thereof.

8 Claims, 4 Drawing Sheets

100

BEDSIDE RAIL

BACKGROUND OF THE INVENTION

The present invention relates to bed rails and, more particularly, one or a pair of bedside rails providing an adjustable rail surface along a bedside to keep elbows from sliding off the bed as well as providing support for users getting in or out of bed.

Getting sufficient sleep is an essential element to a healthy lifestyle. During sleep many things can cause the sleeper to inadvertently wake up, disturbing an otherwise good night's sleep, and thus preventing this essential element. One thing that can cause this disturbance is when an elbow of the sleeper slides off their mattress, jolting the sleeper awake.

As can be seen, there is a need for a beside rail providing and adjustable cushioned surface adjacent to and above an upper surface of the mattress, thereby keeping elbows from sliding off the mattress. This adjustable cushioned surface can also be a support surface for getting in or out of bed. The beside elbow rail may or may not extend to the ground. Two bedside rails can be connected through or under the mattress by a supporting line for preventing either from be knocked over or pushed away from their optimal bedside location.

SUMMARY OF THE INVENTION

In one aspect of the present invention, a bedside rail includes the following: a vertical support having an upper portion and a lower portion operatively associated in such a way that a length of the vertical support is selectively adjustable; a connection point along the upper portion, wherein the connection point is movable relative the upper portion; and a cushioned portion along an upper surface of the vertical support; in certain embodiments, further include the following: a support lock for selectively locking the upper portion relative to the lower portion; a bar lock for selectively locking the connection point relative to the upper portion; and a support line extending from the connection point.

In another aspect of the present invention, a system for coordinating two bedside rails on opposing sides of a mattress includes the following: two bedside rails, each bedside rail providing: a vertical support having an upper portion and a lower portion operatively associated in such a way that a length of the vertical support is selectively adjustable; a connection point along the upper portion, wherein the connection point is movable relative the upper portion; and a cushioned portion along an upper surface of the vertical support; and a support line extending from the connection points of the two bedside rails, wherein at least one of said connection points is configure for selectively adjusting a length of the supporting line between the two bedside rails; wherein certain embodiments including the following: a support lock on each bedside rail, each support lock configured for selectively locking the upper portion relative to the lower portion; and a bar lock on each bedside rail, each bar lock configured for selectively locking the adjustment bar relative to the upper portion.

In yet another aspect of the present invention, a method of preventing an object sliding off an upper surface of a mattress, the method including: providing a bedside rail having the following: a vertical support having an upper portion and a lower portion operatively associated in such a way that a length of the vertical support is selectively adjustable; a connection point along the upper portion, wherein the connection point is movable relative the upper portion; and a cushioned portion along an upper surface of the vertical support; and adjusting the length of the vertical support so that the cushioned portion is adjacent the mattress and the cushioned portion is above the upper surface thereof; interconnecting another bedside rail on an opposing side of the mattress via a support line connecting each connection point; and adjusting a length of the support line so that the cushioned portion of the other bedside rail is adjacent the opposing side of the mattress and the cushioned portion is above the upper surface.

These and other features, aspects and advantages of the present invention will become better understood with reference to the following drawings, description and claims.

DETAILED DESCRIPTION OF THE INVENTION

Figure 1:
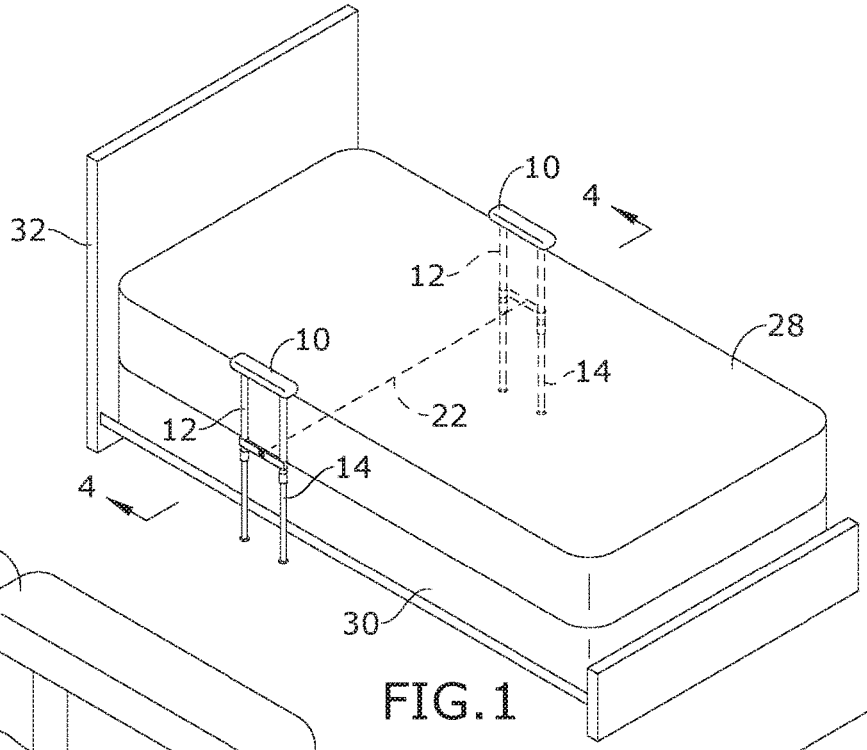
FIG. 1 is a perspective view of an exemplary embodiment of the present invention shown in use.
Figure 2:
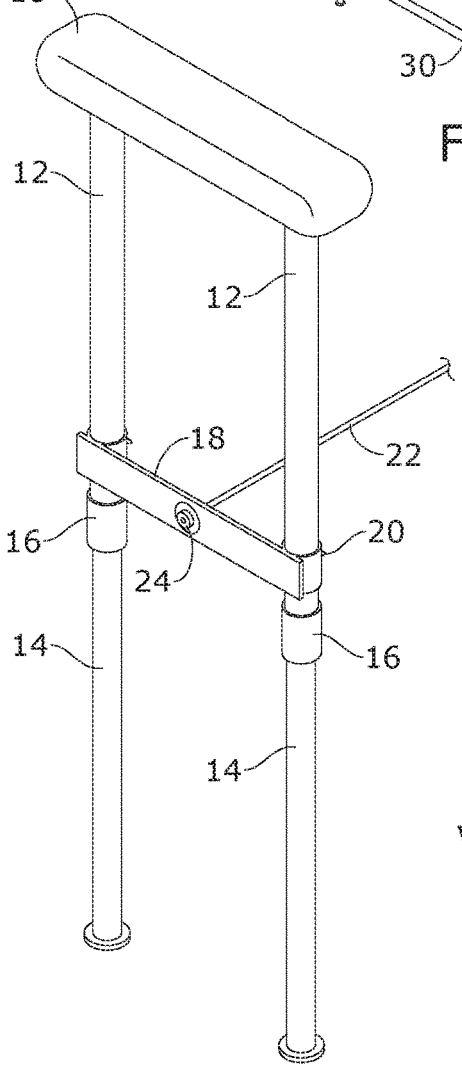
FIG. 2 is a front perspective view of an exemplary embodiment of the present invention with a line anchor 24 in use.
Figure 3:
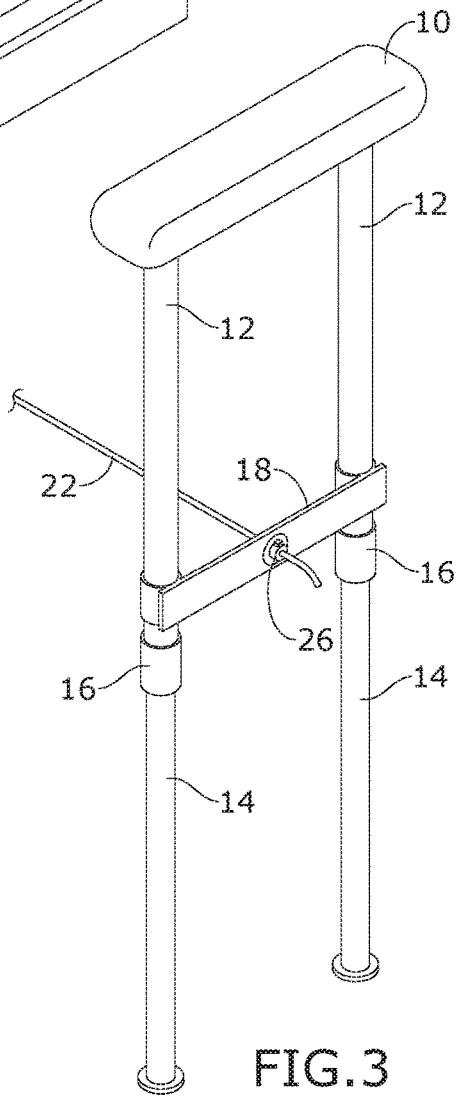
FIG. 3 is a rear perspective view of an exemplary embodiment of the present invention with an adjustable line stop 26 in use.
Figure 4:
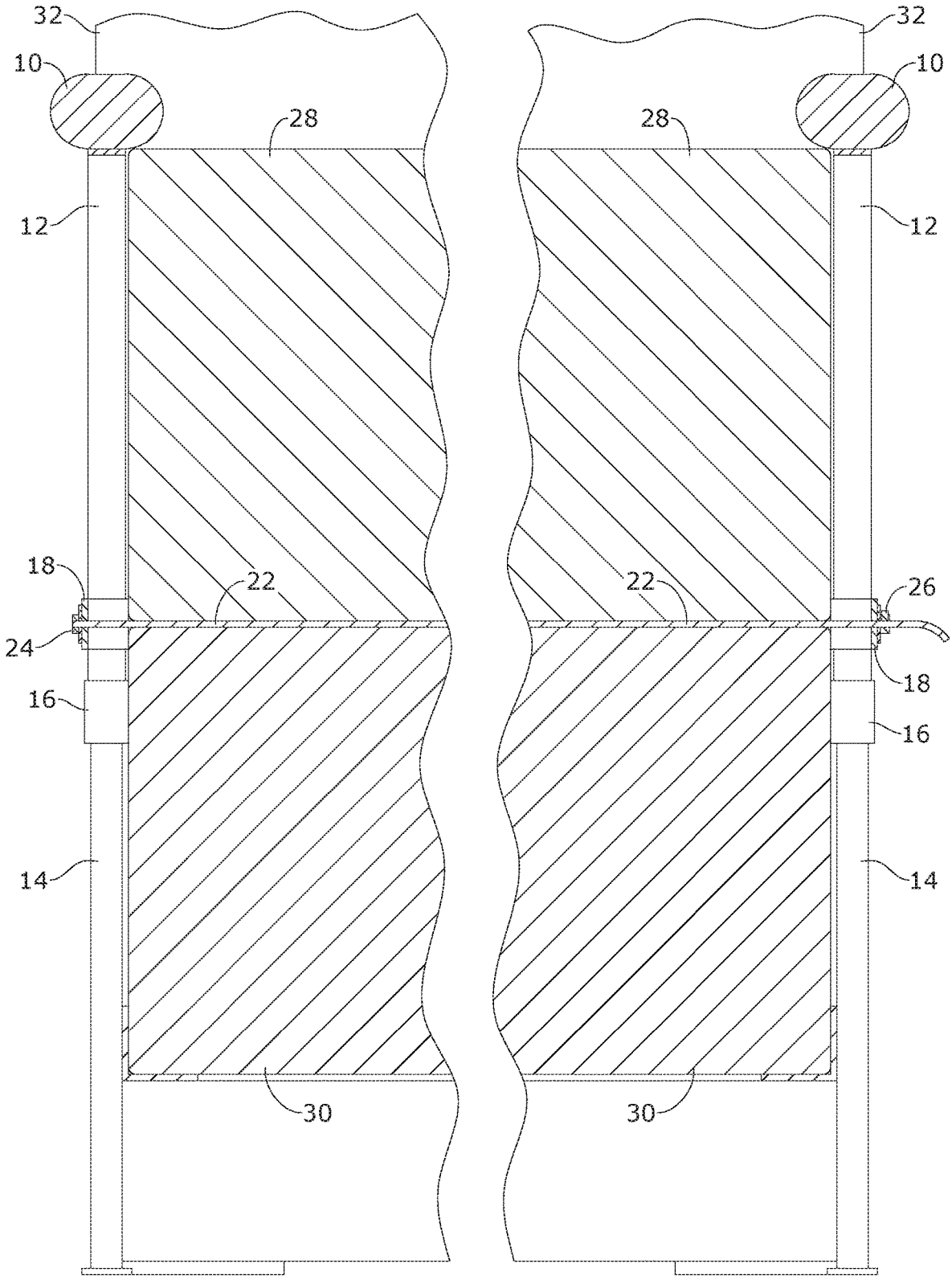
FIG. 4 is a section view of an exemplary embodiment of the present invention, taken along line 4-4 in FIG. 1.
Figure 5:
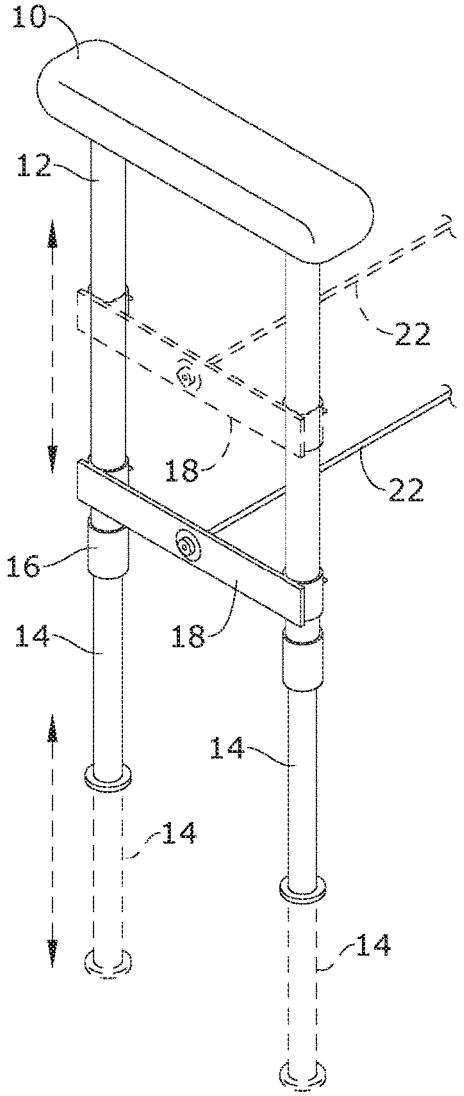
FIG. 5 is a perspective view of an exemplary embodiment of the present invention, illustrating the adjustment of bar 18 and legs 14.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a bedside rail, a system of coordinating two bedside rails, and a method of using the one or more bedside rails to prevent a user of an associated mattress from having their elbows slide off the mattress. Each bedside rail has an adjustable vertical component as well as an adjustable bar that can separately moves along the vertical component. A supporting line can extend between the adjustable bars of two bedside rails along opposing sides of a mattress. A cushioned portion over the vertical component can be selectively elevated adjacent to and above a top surface of the mattress along both sides thereof.

Referring now to FIGS. 1 through 8, the present invention may include a bedside rail 100, a system of coordinating two bedside rails 100, and a method of using the one or more bedside rails 100 to prevent a user of an associated mattress 28 from having their elbows slide off the mattress 28. The bedside rail 100 may also help the user get on and off the mattress 28.

Each bedside rail 100 has one or more vertical supports. The vertical supports may include an upper leg 12 or 38 and a lower leg 14 or 40. Each vertical support may interconnect the upper leg 12/38 and the lower leg 14/40 by way of an adjustable lock 16, whereby the overall height of the vertical support is adjustable by adjusting the length of the upper leg 12/38 relative to the lower leg 14/40. In certain embodiments, the adjustable lock 16/42 may move between a locked position and an unlocked position where the upper leg 12/38 can selectively, telescopically move relative to the lower leg 14/40. The locked position locks the selected relative length between the upper and lower legs 12/38 and 14/40. As a result, a length of the vertical support(s) is(are) adjustable and similarly the elevation of the upper leg 12/38 relative to a mattress 28 is also adjustable.

In embodiments where the bedside rail 100 has two vertical supports, like those illustrated in the FIGS. 1 through 6, an adjustment bar 18 may extend between and connect to the two upper legs 12/38 by way of bar height locks 20. The bar height lock 20 is adapted to be slidable along a length of an engaged upper leg 12 in an unlocked condition yet movable to a locked condition to set a location for the adjustable bar 18 relative to the associated upper leg 12.

Figure 6:
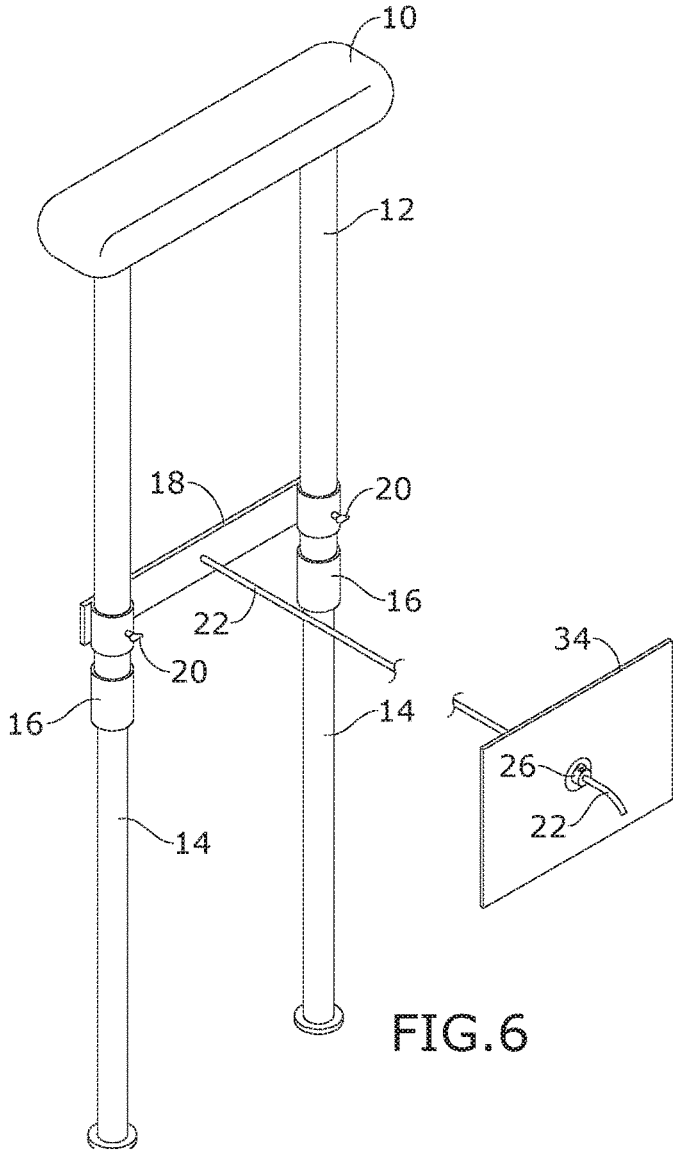
FIG. 6 is a perspective view of an exemplary embodiment of the present invention, illustrating the use of plate 34 to anchor a single rail.
Figure 7:
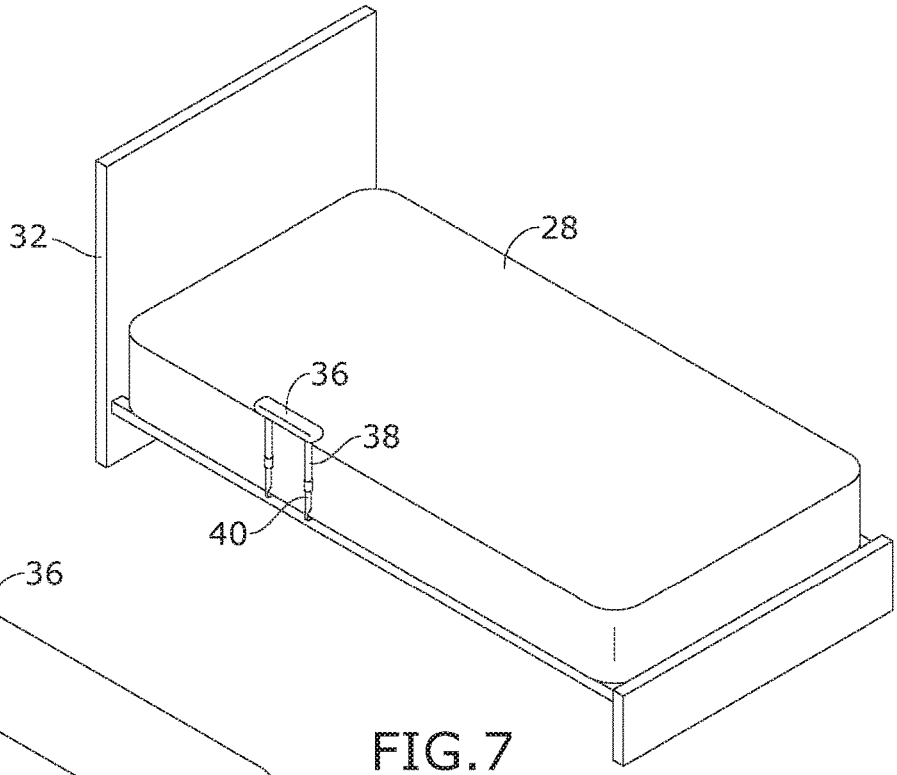
FIG. 7 is a perspective view of an exemplary embodiment of the present invention shown in use.

A support line 22 may extend from the adjustment bar 18. The supporting line 22 may be a cord, cable or the like. In the situations where there are two opposing bedside rails 100, the support line 22 may extend between the two associated adjustment bars 18, where one bedside rail 100 has a fixed anchor 24 connecting the support line 22 to the adjustment bar 18, while the other bedside rail 100 may have an adjustable stop connecting the support line 22 to that adjustment bar 18, making the length of the support line 22 adjustable to accommodate, among other things, mattress widths of different sizes (king, queen, double, single, etc.). In certain embodiments, for example when one side of the mattress 28 is along a wall, a plate 34 can be fixed to that wall to partially anchor the support line 22, as illustrated in FIG. 6. The support line 22 may run under the top mattress 28 and/or between the box spring 30 (or may be designed into the mattress 28), thereby keeping two opposing bedside rails 100 urged against opposing sides of the mattress 28 (or just one bedside rail 100 in the embodiment with the plate 34). Again, the length of the support line 22 is adjustable to fit any size bed 32 or mattress 28: a user may merely tighten the support line 22 to pull the opposing bedside rails 100 together in place. But also the elevation of the support line 22 is adjustable relative the adjustable bar(s) 18.

Figure 8:
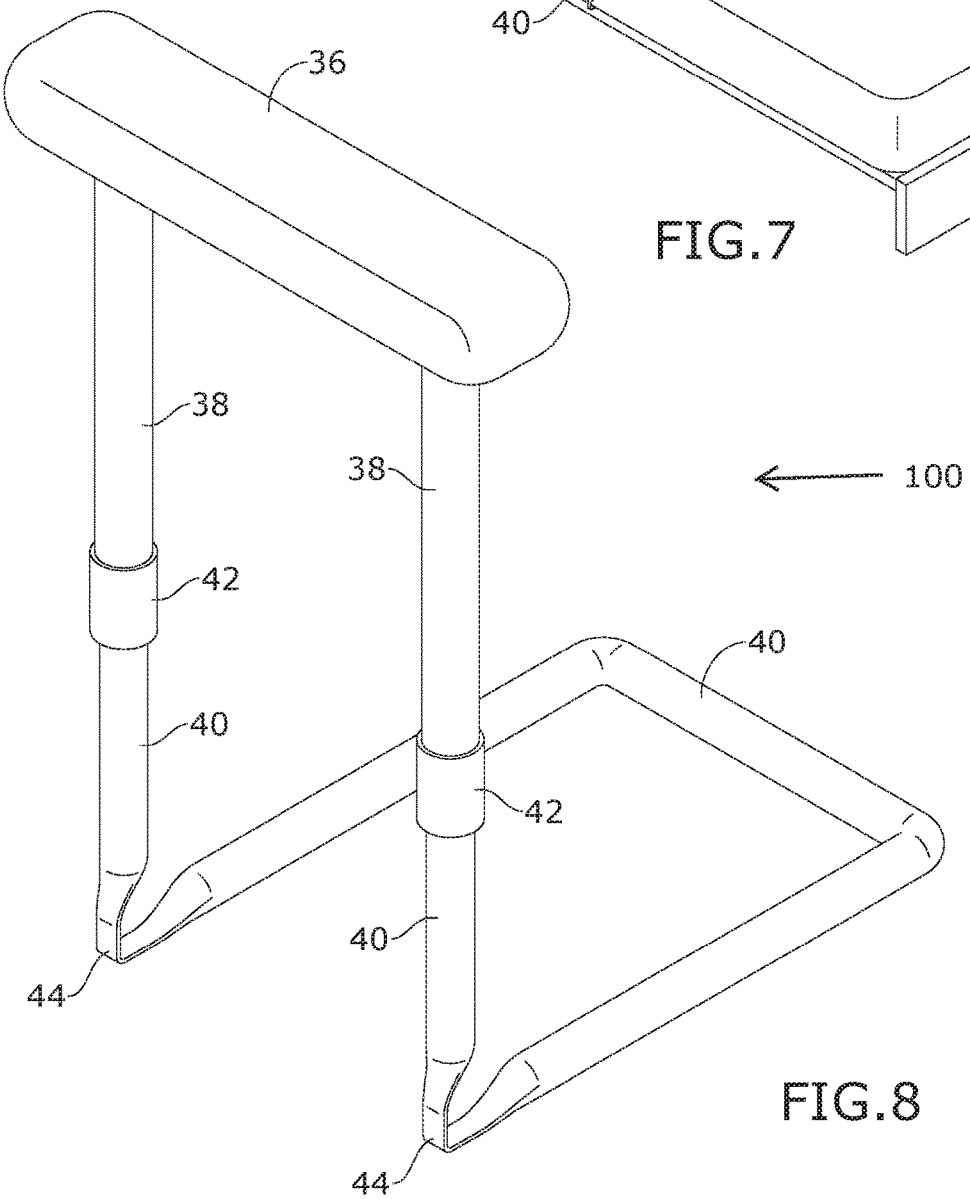
FIG. 8 is a perspective view of an exemplary embodiment of the present invention.

In another embodiments, the lower leg 40 may have an orthogonal portion by way of an elbow 44, as illustrated in FIG. 8, wherein the orthogonal acts as a support foot.

Along a top of the vertical support(s) is a cushioned portion 10 or 36. The cushioned portion 10/36 may be a hardened material about half an inch thick and about eight inches in length. The cushioned portion 10/36 may be raised or indented and adjusted to a desired level by adjusting poles 38/12 into poles 40/14.

A method of using the present invention may include the following. One or more bedside rails 100 may be position along an edge of a mattress 28. The vertical supports enable a user to adjust the desired height for the cushioned portion 10/36 relative to an upper surface of the mattress 28. The cushioned portion 10/36 may act like a rail keeping in the elbows while one sleeps adjacent to an edge of the mattress 28—for better sleeping and creating more space on the mattress 28 because one can sleep closer to the edge of the mattress 28 without their elbows sliding off the mattress 28. Second, if a person chooses, they can use the vertical support(s) as support by pushing down thereon as they get in and out of bed, while the wire or line 22 between or in the mattress 28 supports holding the two opposing bedside rails 100 in place.

It should be understood, of course, that the foregoing relates to exemplary embodiments of the invention and that modifications may be made without departing from the spirit and scope of the invention as set forth in the following claims.

What is claimed is:

1. A bedside rail comprising:

a vertical support having an upper portion and a lower portion operatively associated in such a way that a length of the vertical support is selectively adjustable;

an anchor point along the upper portion, wherein the anchor point is directly connected to an adjustment bar, wherein the adjustment bar is operatively associated with the upper portion so as to be vertically movable along a substantial portion of and relative to the upper portion;

wherein the upper portion comprises two upper legs spaced apart, and wherein the adjustment bar extends between the two upper legs so that the anchor point is disposed between the two upper legs throughout its movement a cushioned portion along an upper surface of the vertical support a support lock for selectively locking the upper portion relative to the lower portion;

a bar lock for selectively locking the anchor point relative to the upper portion; and a support line, wherein the support line consists of a single line, extending for at least three feet from the anchor point.

2. The bedside rail of claim 1, wherein a distal end of the support line is connected to an anchor plate.

3. The bedside rail of claim 2, wherein the anchor plate has an anchor plate point configured for selectively adjusting a length of the supporting line.

4. The bedside rail of claim 3, wherein the support line is directly connected to the anchor plate point which is directly connected to the anchor plate.

5. A system for coordinating two bedside rails on opposing sides of a mattress, comprising:

two bedside rails; each bedside rail comprising;

a vertical support having an upper portion and a lower portion operatively associated in such a way that a length of the vertical support is selectively adjustable in a vertical direction relative to the lower portion;

an anchor point along the upper portion, wherein the anchor point is directly connected to an adjustment bar, wherein the adjustment bar is operatively associated with the upper portion so as to be vertically movable along a substantial portion of and relative to the upper portion;

a cushioned portion along an upper surface of the vertical support;

a support line, wherein the support line consists of a single line, extending from the anchor points of the two bedside rails, wherein at least one of said anchor points is configured for selectively adjusting a length of the supporting line between the two bedside rails;

wherein each upper portion comprises two upper legs spaced apart, and wherein the adjustment bar extends between two upper legs so that the anchor point is disposed between the two upper legs throughout its movement;

a support lock on each bedside rail, each support lock configured for selectively locking the upper portion relative to the lower portion; and a bar lock on each bedside rail, each bar lock configured for selectively locking the adjustment bar relative to the upper portion.

6. A method of preventing an object sliding off an upper surface of a mattress, the method comprising providing the system of claim 5; adjusting the length of the vertical support so that the cushioned portion is adjacent the mattress and the cushioned portion is above the upper surface thereof.

7. The method of claim 6, further comprising:

interconnecting another bedside rail on an opposing side of the mattress via a support line connecting each anchor point; and adjusting a length of the support line so that the cushioned portion of the other bedside rail is adjacent the opposing side of the mattress and the cushioned portion is above the upper surface.

8. The method of claim 7, further comprising adjusting each anchor point vertically along a substantial portion of and relative to the upper portion, respectively, so that the support line is between the mattress and an associated box spring.

* * * * *